US009863635B2

(12) United States Patent
Boguszewski et al.

(10) Patent No.: US 9,863,635 B2
(45) Date of Patent: Jan. 9, 2018

(54) COMBINED IGNITOR SPARK AND FLAME ROD

(71) Applicant: ALSTOM Technology Ltd, Baden (CH)

(72) Inventors: Stanley Joseph Boguszewski, Russell, MA (US); Rebecca Lynn Tobiasz, Suffield, CT (US); Carl David Edberg, Stafford Springs, CT (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 212 days.

(21) Appl. No.: 14/748,655

(22) Filed: Jun. 24, 2015

(65) Prior Publication Data

US 2016/0377286 A1 Dec. 29, 2016

(51) Int. Cl.
*F23N 5/02* (2006.01)
*F23D 5/12* (2006.01)
(Continued)

(52) U.S. Cl.
CPC ..... *F23N 5/022* (2013.01); *F23D 5/12* (2013.01); *F23N 5/126* (2013.01); *F23Q 3/008* (2013.01);
(Continued)

(58) Field of Classification Search
CPC ..... F24C 3/00; F23N 3/00; F23D 5/12
(Continued)

(56) References Cited

U.S. PATENT DOCUMENTS 4,405,299 A * 9/1983 Serber ..... F23N 5/123 431/25
4,680,004 A * 7/1987 Hirt ..... F23G 7/06 220/750

(Continued)

FOREIGN PATENT DOCUMENTS

EP 1 707 880 A1 10/2006
GB 1594349 A 7/1981

(Continued)

OTHER PUBLICATIONS

European Search Report and Opinion issued in connection with corresponding European Application No. 6174903.1 dated Nov. 28, 2016.

*Primary Examiner* — Gregory Huson
*Assistant Examiner* — Nikhil Mashruwala
(74) *Attorney, Agent, or Firm* — GE Global Patent Operation; Stephen G. Midgley

(57) ABSTRACT

Disclosed herein is an ignition system for igniting a flame in a combustion chamber comprising a conduit secured to a windbox wall of the combustion chamber; where the conduit includes a fuel conduit for delivering fuel to the combustion chamber; and a single ignitor and flame rod assembly having a first end and a second end; where the first end comprises a high energy ignitor tip; where the second end is in electrical communication with an electrical power source; where the electrical power source comprises a spark transformer that comprises a primary winding and a secondary winding; a flame monitoring ignitor; where the flame monitoring ignitor is in direct electrical communication with a ground contact and with a low voltage side of the secondary winding; where the flame monitoring ignitor is disposed between the low voltage side of the secondary winding and
(Continued)

a ground contact; and a transient voltage suppressor; that is disposed in parallel with the flame monitoring ignitor.

7 Claims, 6 Drawing Sheets

(51) Int. Cl.
*F23N 5/12* (2006.01)
*F23Q 3/00* (2006.01)

(52) U.S. Cl.
CPC ..... *F23D 2207/00* (2013.01); *F23N 2027/28* (2013.01); *F23N 2027/36* (2013.01); *F23N 2029/12* (2013.01)

(58) Field of Classification Search
USPC ..... 431/6, 173, 46; 340/573
See application file for complete search history.

(56) References Cited

U.S. PATENT DOCUMENTS 5,127,823 A 7/1992 Bonner
5,195,885 A 3/1993 Medina
5,577,905 A 11/1996 Momber et al.
6,311,475 B1 * 11/2001 Ngo-Beelman ..... F02C 7/266 431/264
6,443,728 B1 * 9/2002 Edberg ..... F23D 14/22 431/264
7,289,032 B2 10/2007 Seguin et al.
7,492,269 B2 2/2009 Matteson et al.
8,300,381 B2 10/2012 Chian et al.
8,747,102 B2 6/2014 Boguszewski et al.
9,456,789 B2 * 10/2016 Motoki ..... A61B 6/00
9,546,788 B2 * 1/2017 Strong ..... F23N 5/123
2012/0042785 A1 * 2/2012 Smith ..... A21B 1/48 99/355
2014/0363775 A1 * 12/2014 Saunders ..... F23C 3/008 431/173
2017/0176049 A1 * 6/2017 Perez ..... F24H 9/2085

FOREIGN PATENT DOCUMENTS

JP H1073253 A 3/1998
WO 2013/184928 12/2013

* cited by examiner

COMBINED IGNITOR SPARK AND FLAME ROD

TECHNICAL FIELD

This disclosure relates to a combined ignitor spark and flame rod. In particular, this disclosure relates to a combined ignitor spark and flame rod for a fossil fuel fired combustion chamber.

BACKGROUND

In order to begin the combustion process inside a fossil fuel fired combustion chamber, such as that found in industrial and utility boilers, it is desirable to have an energy source to begin the self-sustaining combustion reaction of fuel and air inside the combustion chamber. Current practice is to use a light fuel oil, natural gas, or propane ignitor of a size between input of 0.5 to 20 Million Btu/hr for each of several fuel admission compartments of the combustion chamber.

Ignitors have a dedicated fuel and air supply and an energy source, typically a spark plug, to produce a flame. In operation, fuel and air are introduced to the ignitor and a spark provides the energy to begin a self-sustaining reaction that keeps the ignitor burning. Proof that the ignitor is operating is established through the use of a flame detector, such as a flame rod, a thermal sensing device, or an optical sensor, that is often integral with the ignitor.

Once the ignitor is proven to be operating, main fuel and air for the combustion chamber can be introduced, often after utilizing the ignitor to preheat the combustion chamber. The energy from the ignitor (the ignitor flame), allows the combustion reaction of the main fuel and air to begin. Generally, once the main fuel and air is ignited, the combustion reaction is self-sustaining and the ignitor can be turned off. However, in some cases, such as due to low volatility of the main fuel, it is necessary to leave the ignitor on in order to keep the main combustion reaction continuing. In other cases, ignitors are left to burn continuously, as may be required by safety laws.

For reasons of safety it is important that the ignitor reliably begin burning on command, and that it be able to be confirmed that the ignitor is producing a flame to insure the safe combustion of the main fuel and air. Failure of an ignitor can result in unsafe accumulations of unburned main fuel and air, resulting in massive explosive damage.

In one type of coal-fired boiler unit, one or more relatively high-capacity oil burners (warm-up guns) are started by one or more oil- or gas-fired ignitors to preheat the combustion chamber. Once the combustion chamber has been brought up to the proper starting temperature, coal nozzles are ignited by the oil- or gas-fired ignitors, or by the warm-up guns themselves.

At higher boiler loads, i.e., when the amount of coal supplied by the coal nozzles is great, the combustion chamber can typically maintain stable combustion of the pulverized coal. However, when the load goes down and the coal supply is thereby decreased, the stability of the pulverized coal flame is also decreased, and it is therefore a common practice to use the ignitors or warm-up guns to maintain the flame in the combustion chamber, thus avoiding the accumulation of unburned coal dust in the combustion chamber and the associated danger of explosion.

Certain portions of an ignitor mounted in a windbox compartment of a combustion chamber are subjected to relatively high temperatures, typically on the order of 500 degrees Fahrenheit or higher. In some conventional ignitors, there is a risk that an ignitor wire supplying energy to an ignitor spark element may burn up due to the high temperatures, especially when insufficient cooling air is supplied to the ignitor.

An ignitor's spray of fuel and air (the combustive mix) is produced by an atomizer. The spray produced by conventional atomizers used in oil-fired ignitors frequently has too many large droplets, resulting in insufficient oxygen at the base of the flame. An insufficient amount of oxygen results in excessive smoke formation, resulting in an unacceptable opacity from the stack.

Introduced above, conventional ignitors, no matter the type of ignitor fuel utilized, include some sort of flame sensing device which may be mechanical or optical. The output of such a flame sensing device is transmitted to a control room where operational decisions are made based upon the sensed flame. If no ignitor flame is detected when one is expected to be present, repair personnel begin servicing the non-performing ignitor based upon only the information that a flame is not present. Lack of a flame could be due to any one of a faulty ignitor fuel supply, a faulty ignitor compressed air, or a faulty ignitor spark source. Further, a flame could actually be present, and the flame detector itself could be sending a false lack of flame signal.

The FIG. 1(A) depicts one embodiment of an existing commercially available ignitor spark and flame rod systems 200 mounted in one of the windboxes of the fossil fuel-fired steam generator (not shown). The FIG. 1 shows two rods—a flame rod system 210 and a spark extension assembly system 215. The ignitor spark and flame rod systems 200 is mounted inside a conduit 201 secured to a windbox wall 205. The ignitor spark and flame rod systems 200 includes a flame rod system 210, a spark extension assembly system 215, a compressed air conduit 225, a fuel conduit 230 collinear and disposed within the compressed air conduit 225, a bluff body 240 disposed at the terminus of the compressed air conduit 225, and an atomizer 235 disposed within the bluff body 240.

The spark extension assembly system 215 includes a solid conductor with an outer ceramic insulation coating, enabling the spark extension assembly system 215 to survive temperatures greater than 1000 degrees Fahrenheit. The spark extension assembly system 215 also contains electrical circuitry shown in the FIG. 1(B) and discussed in detail below. The solid conductor, preferably made of stainless steel, though it could be any other conductive metal, connects to an external electrical power source (not shown in the Figures) at terminus 255. At the opposite end of the spark extension assembly system 215 is a high energy ignitor tip 220. The solid conductor receives electrical current from the power source and conducts the electrical current to the high energy ignitor tip 220, which produces a spark to ignite a spray mixture of the compressed air and fuel released by the atomizer 235. The compressed air conduit 225 facilitates the delivery of compressed air to the high energy ignitor tip 220. The use of compressed air facilitates rapid ignition of the compressed air-fuel mixture when contacted by the spark. The high energy ignitor tip may be a spark plug or alternatively, it can be button of metal welded to the solid conductor. The spark occurs between the button and the ground (also referred to herein as electrodes). The button allows for precise positioning of the spark.

FIGS. 1(B) and 1(C) detail the electrical circuitry for the spark extension assembly system 215 and for the flame rod system 210 respectively. The spark extension assembly system 215 is used to initiate a flame in the furnace by generating a spark across a pair of electrodes that are disposed in the furnace. With respect to the FIG. 1(B), the electrical circuitry for the spark extension assembly system 215 includes an alternating current power source 252 in electrical communication with a spark transformer 250 that comprises a primary winding 254 and a secondary winding 256. The secondary winding 256 is in electrical communication with the spark extension rod 216 that in turn communicates with high energy ignitor tip 220 that comprises two electrodes. As seen in the FIG. 1(B), the two electrodes are separated from each other by an air gap, with the electrode that is not in direct electrical communication with spark transformer being grounded. The low voltage end of the secondary winding 256 is also grounded.

The alternating current power source 252 generates an electrical current that is transmitted to the high energy ignitor tip 220 via the spark transformer. This electrical current is generated upon manual actuation (because it is desired to start combustion in the furnace). Because of the high voltage (e.g., greater than 1000 Volts, preferably greater than 5000 Volts), a spark is created in the air gap between the two electrodes at the high energy ignitor tip 220. The spark ignites the air-fuel mixture in the furnace (not shown) thereby permitting combustion of the air-fuel mixture.

The electrical circuitry for the flame rod system 210 is depicted in the FIG. 1(B). The flame rod system 210 is used to indicate a lack of a flame during operation of the furnace. The flame rod system 210 comprises a flame monitoring rod 270, a flame monitoring sensor 265, a flame monitoring ignitor 272 and a ground contact 274, all of which are in electrical communication with one another.

In operation, the flame rod system 210 is charged to approximately 40 volts DC, allowing for an optimum signal-to-noise ratio. As flame ions interact with the flame monitoring rod 270, the voltage dips and rises. These voltage fluctuations are measured by a flame monitoring sensor 265. The flame monitoring ignitor 272 is a complete ignition system containing an electrical spark source, a self-stabilizing burner device, flame detection, and fuel input monitoring systems. The flame monitoring ignitor 304 takes advantage of the production of ions and charged particles during the combustion of hydrocarbon fuels. Due to the presence of these particles, a hydrocarbon-fuel flame will conduct electricity.

When a DC potential is placed across a flame, the electric current flow varies at the same frequency as the flame pulsation. The flame monitoring ignitor 272 operates by imposing a DC potential on an electrode called the flame rod, which is in contact with the flame. When there is "no flame," the DC voltage remains at the originally imposed level, and no current flows. When there is "flame," the DC voltage drops as current flows, generating an AC feedback signal. This AC signal is filtered, amplified, and modified by the flame monitoring ignitor electronics to drive a flame indication relay. If a component failure occurs (e.g., a short circuit in the flame rod or signal lead wire, or an external AC interference), a "no flame" indication will occur. The indication of a "no flame" signal generally leads one to actuate of the spark extension assembly system 215 via a switch (not shown), which restarts the ignition process.

As seen from the FIG. 1(A), most existing commercially available ignitor spark and flame rod systems have two or more protruding rod assemblies for spark ignition and for flame sensing and proving. These protruding rods are sometimes identical in appearance. Each of these protruding rods uses internal stand-offs, an external connector assembly, an external wire train and requires dedicated conduit and wire to be run back to the ignitor control cabinet.

Elimination of some of these supporting elements for two protruding rods would reduce manufacturing costs, increase manufacturing speed and also eliminate some of the problems detailed above that are associated with the various ignitor functions.

SUMMARY

Disclosed herein is an ignition system for igniting a flame in a combustion chamber comprising a conduit secured to a windbox wall of the combustion chamber; where the conduit includes a fuel conduit for delivering fuel to the combustion chamber; and a single ignitor and flame rod assembly having a first end and a second end; where the first end comprises a high energy ignitor tip; where the second end is in electrical communication with an electrical power source; where the electrical power source comprises a spark transformer that comprises a primary winding and a secondary winding; a flame monitoring ignitor; where the flame monitoring ignitor is in direct electrical communication with a ground contact and with a low voltage side of the secondary winding; where the flame monitoring ignitor is disposed between the low voltage side of the secondary winding and a ground contact; and a transient voltage suppressor; that is disposed in parallel with the flame monitoring ignitor.

Disclosed herein too is a method comprising discharging a mixture of compressed air and fuel into a combustion chamber from a fuel conduit; and discharging a spark into the combustion chamber from an ignition system, where the ignition system comprises a single ignitor and flame rod assembly having a first end and a second end; where the first end comprises a high energy ignitor tip; where the second end is in electrical communication with an electrical power source; where the electrical power source comprises a spark transformer that comprises a primary winding and a secondary winding; a flame monitoring ignitor; where the flame monitoring ignitor is in direct electrical communication with a ground contact and with a low voltage side of the secondary winding; where the flame monitoring ignitor is disposed between the low voltage side of the secondary winding and a ground contact; and a transient voltage suppressor; that is disposed in parallel with the flame monitoring ignitor.

DETAILED DESCRIPTION

Disclosed herein is an ignitor and flame rod that comprises a single protruding rod assembly for spark ignition and for flame sensing and proving. The system comprises no other spark ignition rod or flame detection rod. Because the device comprises a single protruding rod assembly to house both the spark ignition and the flame sensing functions it eliminates at least one internal stand-off, one external connector assembly, one external wire train and one dedicated conduit and wire that typically runs back to the ignitor control cabinet. In addition to reducing the number of internal parts, it also speeds up manufacturing thereby reduces the cost of manufacturing. Problems associated with the additional circuitry are also eliminated.

An electrical spark is the typical initiating source of fuel ignition in combustion devices. High voltage, free-air sparks can reliably ignite high-calorific-value gases and light (distillate) oils. High-energy, surface-shunted arcs (High Energy Arc (HEA)) ignitors are used to reliably ignite distillate and heavy (residual) oils. The type of system selected depends on fuel availability and cost. High-quality gas and distillate oil are preferred for both ignition systems and for boiler warm-up, because such gas and oil are easier to handle and burn more cleanly in cold furnaces. Safety considerations indicate that because of its relatively low ignition energy, only a limited quantity of fuel be exposed to the electrical spark. The heat released from this initial fuel input then becomes the ignition energy for a different and/or larger fuel input (e.g. pilot). Essentially, the ignition system provides a controlled transition from spark to main-fuel firing through an incremental increase in the ignition energy.

As can be seen from the aforementioned discussion, combustion systems (e.g., steam generators such as boilers) are very dependent on their ignition systems for safe start-up and shut down operations. The need to ensure reliable and safe firing conditions has caused the evolution from simple ignitors to highly sophisticated ignition systems. Sophisticated ignition systems generally display the following features: a) a timed spark-ignition sequence, b) a device to create turbulent fuel/air mixing and sufficient hot-gas recirculation to insure flame stability, c) a device to detect and monitor the ignitor flame and d) a device to monitor ignitor fuel flow as an indication of ignitor heat energy release.

Figure 2:
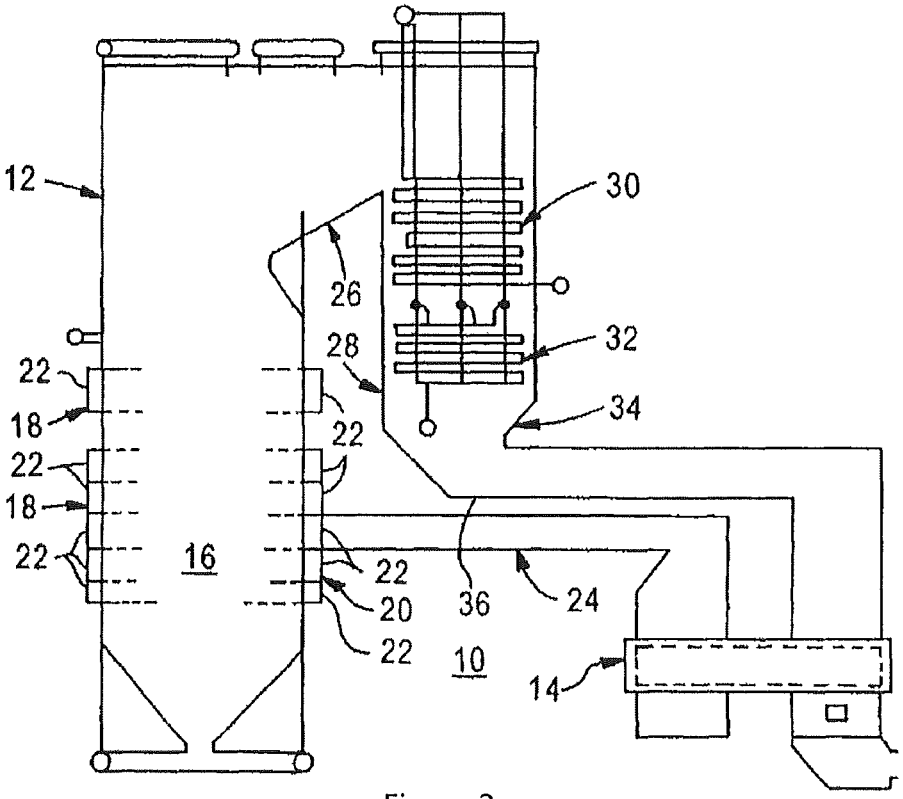
FIG. 2 depicts a conventional fossil fuel-fired power generation system.

Referring now to the drawings, and more particularly to the FIG. 2, there is depicted a conventional fossil fuel-fired power generation system, generally designated by the reference numeral 10, having installed therein a preferred embodiment of the ignitor disclosed herein. It should be understood that the ignitor may be utilized in industrial or utility installations other than that depicted in FIG. 2. The fossil fuel-fired power generation system 10 includes a fossil fuel-fired steam generator 12 and an air preheater 14.

The fossil fuel-fired steam generator 12 includes a burner region. It is within the burner region 16 of the fossil fuel-fired steam generator 12 that the combustion of fossil fuel and air, in a manner well-known to those skilled in this art, is initiated. To this end, the fossil fuel-fired steam generator 12 is provided with a conventional firing system 18.

The firing system 18 includes a housing, preferably in the form of a windbox 20. The windbox 20 includes a plurality of compartments, each designated 22. In conventional fashion, some of the compartments 22 are designed to function as fuel compartments from which fossil fuel is injected into the burner region 16, while others of the compartments 22 are designed to function as air compartments from which air is injected into the burner region 16. The fossil fuel is supplied to the windbox 20 by a conventional fuel supply means, not shown in the interest of maintaining clarity of illustration in the drawing. At least some of the air which is injected into the burner region 16 for purposes of effecting combustion of the injected fuel is supplied to the windbox 20 from the air preheater 14 through the duct 24.

It is within the burner region 16 of the fossil fuel-fired steam generator 12 that the combustion of the fossil fuel and air is initiated. The hot gases that are produced from this combustion of the fossil fuel and air rise upwardly in the fossil fuel-fired steam generator 12. During the upwardly movement thereof in the fossil fuel-fired steam generator 12, the hot gases, in a manner well-known to those skilled in this art, give up heat to fluid flowing through tubes (not shown in the interest of maintaining clarity of illustration in the drawing) that in conventional fashion line all four of the walls of the fossil fuel-fired steam generator 12. Then, the hot gases flow through the horizontal pass 26 of the fossil fuel-fired steam generator 12, which in turn leads to the rear gas pass 28 of the fossil fuel-fired steam generator 12. Although not shown in FIG. 2, it should be understood that the horizontal pass 26 would commonly have suitably provided therein some form of a heat transfer surface. Similarly, heat transfer surface, as illustrated at 30 and 32, is suitably provided within the gas pass 28. During passage through the rear gas pass 28 the hot gases give up heat to the fluid flowing through the tubes of the heat transfer surface.

Upon exiting from the rear gas pass 28 of the fossil fuel-fired steam generator 12 the hot gases are conveyed to the air preheater 14. To this end, the fossil fuel-fired steam generator 12 is connected from the exit end 34 thereof to the air preheater 14 by means of duct work 36. After passage through the air preheater 14, the now relatively cooler hot gases are further conducted to conventional treatment apparatus which are not illustrated in the interest of clarity.

Figure 3A:
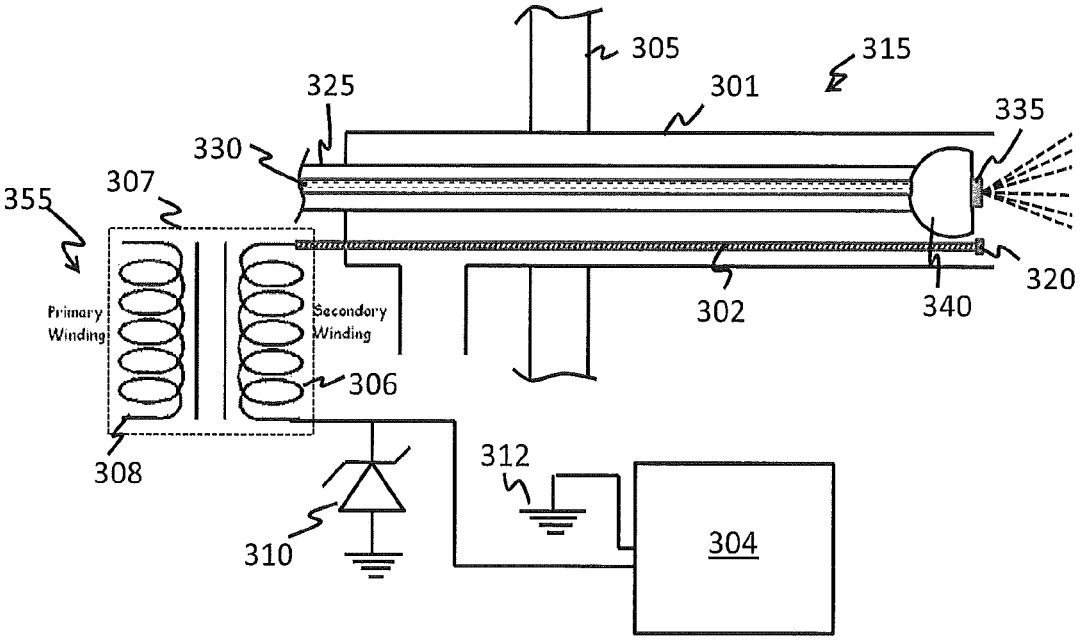
FIG. 3(A) shows that a combination of the spark and flame rods is accomplished by isolating the spark transformer secondary from ground, and connecting a flame monitoring ignitor rod input to the low voltage side of the spark transformer secondary. A transient voltage suppressor (TVS) was placed in parallel with the flame monitoring ignitor input.

The fossil fuel-fired steam generator 12 is provided with a preferred embodiment of the ignitor disclosed herein. FIG. 3(A) shows an ignitor 315 mounted in one of the windboxes of the fossil fuel-fired steam generator 12 of the FIG. 2. It should be understood that the fossil fuel-fired steam generator 12, as well as any other industrial or utility installation, can be provided with any desired number of the ignitors disclosed herein.

In the FIG. 3(A), the ignitor 315 is mounted inside a conduit 301 secured to a windbox wall 305. The ignitor 315 includes an ignitor and flame rod 302, a compressed air conduit 325, a fuel conduit 330 co-linear and disposed within the compressed air conduit 325, a bluff body 340 disposed at the terminus of the compressed air conduit 325, and an atomizer 335 disposed within the bluff body 340.

The ignitor and flame rod assembly 315 combines the separate spark and flame rods of other commercially available ignitors into a single spark and flame rod 302 that includes a solid conductor with an outer ceramic insulation coating, enabling the ignitor and flame rod assembly 315 to survive temperatures greater than 1000 degrees Fahrenheit. The solid conductor is preferably made of stainless steel, though it could be any other conductive metal, and is in electrical communication with an external electrical power source 355. At the opposite end of the ignitor and flame rod assembly 315 is a high energy ignitor tip 320. The solid conductor receives electrical current from the power source and conducts the electrical current to the high energy ignitor tip 320, which produces a spark to ignite a spray mixture of the compressed air and fuel released by the atomizer 335.

Figure 1A:
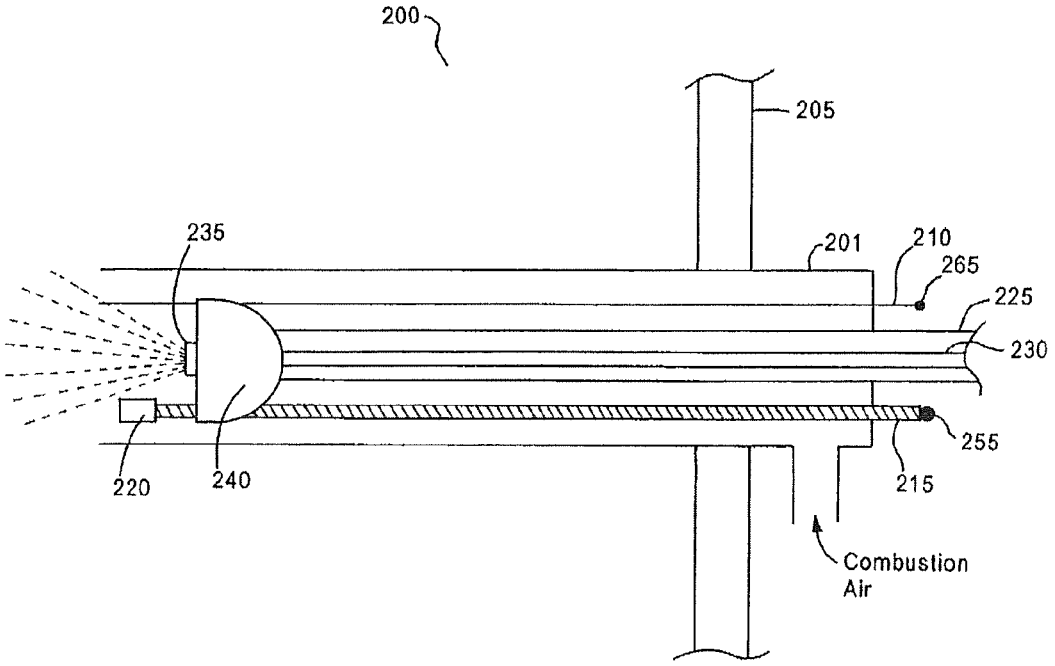
Figure 1(A) (Prior Art)
FIG. 1(A) depicts one embodiment of an existing commercially available ignitor spark and flame rod mounted in windbox of a fossil fuel-fired steam generator. The system comprises two rods—an ignitor spark rod and a flame rod.
Figure 1B:
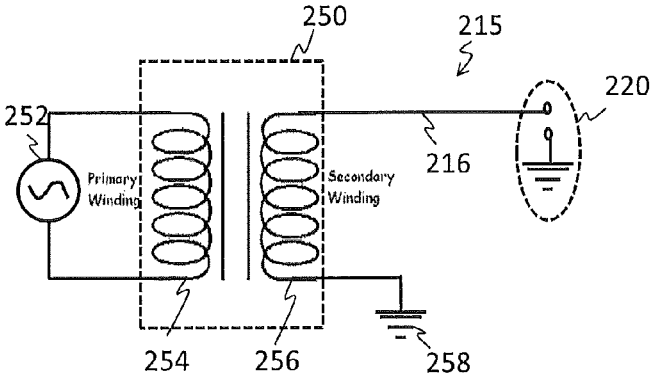
Figure 1(B) (Prior Art)
FIG. 1(B) depicts the electrical circuitry for the ignitor spark rod system.
Figure 1C:
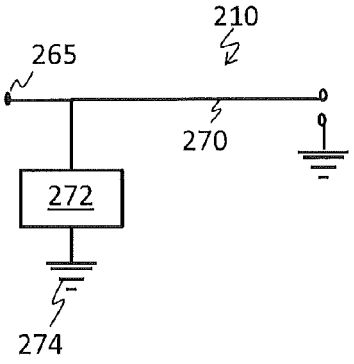
Figure 1(C) (Prior Art)
FIG. 1(C) depicts the electrical circuitry for the flame detection rod system.

The ignitor and flame rod assembly 315 combines the separate spark and flame rods of the FIG. 1. It therefore combines the functions of spark generation (from the spark rod of commercially available ignitors) with the flame monitoring capabilities of the flame rod of commercially available ignitors. The combination of the spark generating capabilities with flame detection capabilities in a single ignitor and flame rod assembly 315 is made possible by the design of the external electrical power source 355 detailed below that it is in electrical communication with the ignitor and flame rod assembly 315.

The electrical power source 355 is depicted in the FIG. 3(A). FIG. 3(A) shows that a combination of the spark and flame rods is accomplished by isolating the spark transformer secondary winding from ground, and connecting a flame monitoring ignitor rod input to the low voltage side of the spark transformer secondary winding. A transient voltage suppressor (TVS) was placed in parallel with the flame monitoring ignitor input.

Figure 3B:
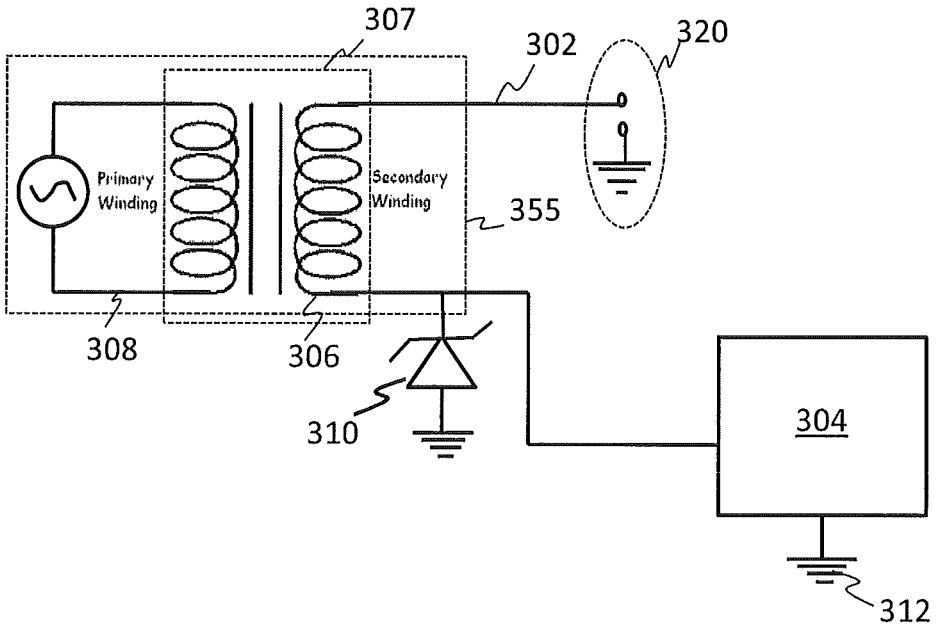
FIG. 3(B) depicts the electrical circuitry for the combination of the spark and flame rods.

FIG. 3(B) depicts the electrical circuitry for the combined ignitor and flame rod assembly 315. With reference now to the FIGS. 3(A) and 3(B), the combined ignitor and flame rod assembly 315 comprises a spark transformer 307, a transient voltage suppressor 310, a flame monitoring ignitor 304 and a ground contact 312, all of which are in electrical communication with one another. As seen in the FIGS. 3(A) and 3(B), the electrical power source 355 is designed to isolate the spark transformer secondary winding 306 from ground 312 by placing a flame monitoring ignitor 304 between the low voltage side of the spark transformer secondary 306 and the ground contact 312.

The spark transformer 307 comprises a primary winding 308 and a secondary winding 306. The primary winding 308 is in electrical communication with an alternating current source (See FIG. 3(B)) while the low voltage side of the secondary winding is in electrical communication with the flame monitoring ignitor 304 and the transient voltage suppressor 310. The high voltage side of the secondary winding is in electrical communication with the ignitor rod 302.

The transient voltage suppressor 310 is installed in parallel with the flame monitoring ignitor 304 to carry spark current. The transient voltage suppressor is useful for protection against very fast and often damaging voltage spikes from electrical overstress such as that caused by electrostatic discharge, inductive load switching and induced lightning. These fast overvoltage spikes are present on all distribution networks and can be caused by either internal or external events. The flame monitoring ignitors' 304 direct current (DC) bias voltage will have a path to the ignitor and flame rod assembly 315 via the transient voltage suppressor 310.

In an exemplary embodiment, the transient voltage suppressor is a Zener diode. The Zener voltage is set to a value that protects the flame monitoring ignitor 304 from damage when voltage generated is greater than that set value. In an exemplary embodiment, the Zener diode has a breakdown voltage greater than the ionic flame monitoring devices' 40 volt (V) flame rod bias to avoid interfering with the flame monitoring. When for example, a switch (not shown) is activated to initiate a spark between the electrodes of the high energy ignitor tip 320, the voltage generated by the electrical power source 355 is greater than 1000 V. The Zener diode, which is set to slightly a value slightly greater than 40 V (e.g., 42 V) prevents the electrical current generated by the high voltage (e.g., greater than 1000 V) from shorting out or otherwise damaging the ionic flame monitoring device 304.

Figure 4:
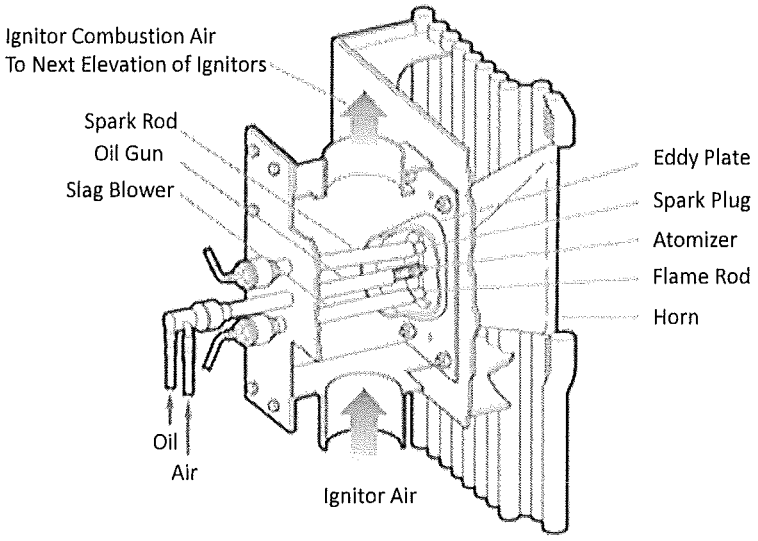
FIG. 4 depicts an ionic flame monitoring side ignition system.

The flame monitoring ignitor 304 (also referred to as an ionic flame monitoring (IFM) ignitor or and ionic flame monitoring (IFM) device) is generally used in tangentially and horizontally fired systems. The flame monitoring ignitor 304 is a complete ignition system containing an electrical spark source, a self-stabilizing burner device, flame detection, and fuel input monitoring systems. A high-voltage spark or high energy arc source can be used for ignition. Either gas, ranging from coke-oven gas to butane or No. 2 fuel oil is used with this type of system. Flame detection is also achieved with the flame monitoring ignitor device. Flow switches monitor fuel input. The FIG. 4 shows a typical flame monitoring ignitor 304.

The flame monitoring ignitor 304 takes advantage of the production of ions and charged particles during the combustion of hydrocarbon fuels. Due to the presence of these particles, a hydrocarbon-fuel flame will conduct electricity. Another characteristic of turbulent flames is that they continuously pulsate at some constant frequency. The quantity of ions and charged particles generated varies as the flame pulsates. Thus, the conductivity of the flame also changes with the pulsation of the flame.

When a DC potential is placed across a flame, the electric current flow varies at the same frequency as the flame pulsation. The flame monitoring ignitor 304 operates by imposing a DC potential on an electrode called the flame rod, which is in contact with the flame. When there is "no flame," the DC voltage remains at the originally imposed level, and no current flows. When there is "flame," the DC voltage drops as current flows, generating an AC feedback signal. This AC signal is filtered, amplified, and modified by the flame monitoring ignitor electronics to drive a flame indication relay. The electronics are designed to be fail-safe. If a component failure occurs (e.g., a short circuit in the flame rod or signal lead wire, or an external AC interference), a "no flame" indication will occur. A switch (not shown) may then be manually depressed to activate a spark across the electrodes of the high energy ignitor tip 320.

In an exemplary embodiment, the single rod concept can be accomplished by placing an ionic flame monitoring device, such as the Alstom diagnostic flame indicator (DFI-100), between the spark transformer secondary winding low voltage side and the ground contact. Transient voltage suppressor(s) are installed in parallel with the flame monitoring device to carry spark current. With this configuration, the transient voltage suppressor provides a ground path for the spark transformer current. When not sparking, the ionic flame monitoring device has a path through the transformer secondary for flame monitoring. The transient voltage suppressor has a breakdown voltage higher than the ionic flame monitoring devices 40 volt (V) flame rod bias to avoid interfering with the flame monitoring.

In one exemplary method of operation, the ignitor and flame rod assembly 315 is charged to approximately 40 volts DC, allowing for an optimum signal-to-noise ratio. As flame ions interact with the ignitor and flame rod assembly 315, the voltage dips and rises. These voltage fluctuations are measured in terms of the AC feedback signal. As noted above, this AC signal is filtered, amplified, and modified by the flame monitoring ignitor electronics to drive the flame monitoring ignitor device 304, which then drives the amount of air and fuel ejected from the atomizer 335 as well as the generation of sparks at the high energy ignitor tip 320.

This concept is envisioned for gas ignitors, both in pipe and side configurations. This includes the 3 inch to 5 inch bluff body, the 3 inch eddy plate and 6 inch side ignitor designs. It is to be noted that while the primary use is generally gas, this high voltage spark ignition method can be used for light oil ignitors and is specified occasionally and upon customer request. The single rod design results in greater than 30% cost savings and increase in rated output [MBtu/hr] and an improved flame signal. The design reduces the obstructions to air flow, improves recirculation and allows for better overall air distribution for ignition purposes while eliminating an entire ionic flame monitoring wand and wire train assembly. During tests the top end ignitor capacity has been seen to increase by 10 to 15% for systems having the disclosed single ignitor and flame rod assembly 315 over comparative devices that used conventional ignitors that have two rods (an ignitor spark rod and a flame rod) instead.

The invention is embodied in the following non-limiting example.

EXAMPLE

This example was conducted to demonstrate the functioning of the disclosed single ignitor and flame rod assembly in a combustion system. Tests were performed using an Alstom ignitor control cabinet, and Critical Technologies Lab's demo 3" bluff body igniter. The spark transformer was removed from the ignitor cabinet and placed on an insulated surface. Since the transformer secondary is normally grounded through its mounting screws, removing the transformer from the cabinet isolated the transformer secondary from ground. The transformer primary wires were extended to maintain the connections.

An On Semiconductor 1SMB43AT3G transient voltage suppressor was connected between the transformer ground connection, and the cabinet ground. The transient voltage suppressor choice was made based on available on-hand parts, and should not be considered a recommendation for a commercial design. The diagnostic flame indicator (DFI) flame rod input was connected to the transformer ground connection.

Prior to changing the ignitor control cabinet to the above described configuration, a flame test was performed with the DFI connected directly to the flame rod to provide a reference point.

Flame was applied between the flame rod and ground using a hand held propane torch. Values measure by the DFI are as follows:

Intensity=40%

AC=14%

Frequency=130 Hz

The cabinet was then changed to the above described test configuration. The flame test was repeated with the following results:

Intensity=36%

AC=18%

Frequency=130 Hz

This test confirms the DFIs ability to detect flame when connected to the flame rod through the spark transformer secondary. Power was applied to the spark transformer primary for an interval of 10 seconds. This is the typical spark duration during an ignitor startup. When power was applied there was a strong blue spark between the spark/flame rod and ground.

The 10 second spark was repeated several times, and the flame was again applied to the spark/flame rod. When the flame was applied the DFI was able to detect flame with readings similar to those obtained in test described.

This test confirms that the DFI will not be damaged by the high voltage spark when in the test configuration.

It is to be noted that all ranges detailed herein include the endpoints. Numerical values from different ranges are combinable.

The transition term comprising encompasses the transition terms "consisting of" and "consisting essentially of".

The term "and/or" includes both "and" as well as "or". For example, "A and/or B" is interpreted to be A, B, or A and B.

While the invention has been described with reference to some embodiments, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. An ignition system for igniting a flame in a combustion chamber comprising:

a conduit secured to a windbox wall of the combustion chamber; where the conduit includes:

a fuel conduit for delivering fuel to the combustion chamber; and a single conductive rod operative to generate a spark in the combustion chamber and to sense a flame in the combustion chamber, having a first end and a second end; where the first end comprises a high energy ignitor tip; where the second end is in electrical communication with an electrical power source; where the electrical power source comprises;

a spark transformer that comprises a primary winding, and a secondary winding isolated from ground;

a flame monitoring ignitor; where the flame monitoring ignitor is, in electrical communication with a ground contact and with a low voltage side of the secondary winding; where the flame monitoring ignitor is disposed between the low voltage side of the secondary winding and the ground contact; and a transient voltage suppressor; that is disposed in parallel with the flame monitoring ignitor.

2. The ignition system of claim 1, where the flame monitoring ignitor is a diagnostic flame indicator that comprises at least one of an electrical spark source, a self-stabilizing burner device, and flame detection systems.

3. The ignition system of claim 1, where the fuel conduit is collinear and disposed within the compressed air conduit.

4. The ignition system of claim 3, further comprising a bluff body disposed at a terminus of the compressed air conduit and an atomizer disposed within a bluff body.

5. The ignition system of claim 1, where the system comprises no additional rods operative to spark ignition or detect a flame detection.

6. The ignition system of claim 1, where the high energy ignitor tip is a metal button welded to a conductive metal rod.

7. A method comprising:

discharging a mixture of compressed air and fuel into a combustion chamber from a fuel conduit, and discharging a spark into the combustion chamber from an ignition system, where the ignition system comprises:

a single conductive rod having a first end and a second end; where the first end comprises a high energy ignitor tip; where the second end is in electrical communication with an electrical power source; where the electrical power source comprises:

a spark transformer that comprises a primary winding and a secondary winding; a flame monitoring ignitor; where the flame monitoring ignitor is in direct electrical communication with a ground contact and with a low voltage side of the secondary winding; where the flame monitoring ignitor is disposed between the low voltage side of the secondary winding and a ground contact; and a transient voltage suppressor; that is disposed in parallel with the flame monitoring ignitor.

* * * * *